US009694582B1

(12) United States Patent
Stephens et al.

(10) Patent No.: US 9,694,582 B1
(45) Date of Patent: Jul. 4, 2017

(54) SINGLE JET RECIRCULATION IN AN INKJET PRINT HEAD

(71) Applicant: XEROX CORPORATION, Norwalk, CT (US)

(72) Inventors: Terrance L. Stephens, Canby, OR (US); David A. Tence, Tualatin, OR (US); Ryan J. Evens, Wilsonville, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/090,335

(22) Filed: Apr. 4, 2016

(51) Int. Cl.
*B41J 2/14* (2006.01)
*B41J 2/18* (2006.01)
*B41J 2/175* (2006.01)

(52) U.S. Cl.
CPC ..... *B41J 2/1433* (2013.01); *B41J 2/18* (2013.01); *B41J 2/14201* (2013.01); *B41J 2/14274* (2013.01); *B41J 2/17506* (2013.01); *B41J 2002/14419* (2013.01)

(58) Field of Classification Search
None
See application file for complete search history.

(56) References Cited

U.S. PATENT DOCUMENTS

| | | | | |
|---|---|---|---|---|
| 7,222,937 | B2 | 5/2007 | Brookfield et al. | |
| 7,857,432 | B2 | 12/2010 | Stephens et al. | |
| 2002/0186270 | A1 | 12/2002 | Sharma | |
| 2010/0220146 | A1* | 9/2010 | Menzel | B41J 2/1404 347/40 |
| 2011/0128335 | A1 | 6/2011 | von Essen et al. | |

OTHER PUBLICATIONS

Stainless Steel article, retrieved from www.madehow.com/Volume-1/Stainless-Steel.html [retrieved on Nov. 14, 2016], originally posted Feb. 4, 2006.*

* cited by examiner

*Primary Examiner* — Lisa M Solomon
(74) *Attorney, Agent, or Firm* — Marger Johnson

(57) ABSTRACT

An inkjet print head including a plurality of single jet elements. Each single jet element includes an aperture configured to eject ink during a jetting event, a channel for receiving ink. The inkjet print head also includes a first manifold structured to supply ink to the channel; and a plurality of recirculation paths. Each recirculation path configured to receive ink during the jetting event and a non-jetting event. Each recirculation path includes a recirculation channel connected to the channel for receiving ink, the recirculation channel is formed by half-etching one of the steel plates that forms part of the each of the single jet elements and the recirculation paths, and a second manifold structured to receive ink from the recirculation channel. The ink flows from the first manifold to the second manifold through each of the plurality of single jet elements and the recirculation paths during a non-jetting event.

16 Claims, 5 Drawing Sheets

SINGLE JET RECIRCULATION IN AN INKJET PRINT HEAD

TECHNICAL FIELD

This disclosure relates to inkjet printing, more particularly to recirculation paths in inkjet print heads.

BACKGROUND

Typical inkjet print heads consist of a supply manifold structure that supplies ink to inlet portions of a plurality of single jet elements. Along with the inlet portions, each of the plurality of single jet elements typically has a single outlet portion which includes one or multiple apertures through which drops are ejected during ink jetting. Within this fluidic structure, ink within the supply manifold and single jet elements experiences bulk fluid flow during jetting events. During periods of time when no jetting events occur, however, ink within the fluidic structure experiences no bulk flow and can become substantially quiescent. Periods of quiescent allow particles suspended within the ink to undergo settling. Settling can adversely affect performance of the fluidic structure, as well as change desired properties of the ink within the system.

Embodiments of the invention address these and other limitations in the prior art.

SUMMARY

One embodiment is An inkjet print head has a plurality of single jet elements, each single jet element including an aperture configured to eject ink during a jetting event, and a channel for receiving ink, a first manifold structured to supply ink to the channel, and a plurality of recirculation paths, each recirculation path configured to receive ink during the jetting event and a non-jetting event and each recirculation path including a recirculation channel connected to the channel for receiving ink, the recirculation channel is formed by half-etching one of the steel plates that forms part of the each of the single jet elements and the recirculation paths, and a second manifold structured to receive ink from the recirculation channel, wherein the ink flows from the first manifold to the second manifold through each of the plurality of single jet elements and the recirculation paths during a non-jetting event.

A method of controlling pressures in a print head includes applying a first negative pressure to a first manifold structure connected to a channel during a non-jetting event, applying a second negative pressure lower than the first negative to a second manifold structure downstream from the first manifold structure to create a pressure differential, the second manifold structure connected to a recirculation channel that receives ink from the channel during a non-jetting event, and maintaining the pressure differential between the first manifold structure and the second manifold structure during a jetting event.

DETAILED DESCRIPTION OF THE EMBODIMENTS

Some fluid dispensing assemblies include a local fluid supply and a fluid dispensing subassembly. The local fluid supply may reside in one or more reservoir chambers within a reservoir assembly. The fluid dispensing subassembly may be viewed as having several components. First, the driver component may consist of the transducer, such as a piezoelectric transducer, that causes the fluid to exit the subassembly, the diaphragm upon which the transducer operates, and the body plate or plates that form the pressure chamber. Second, an inlet component consists of the channel that directs the fluid from the manifold toward the pressure chamber. Next, the outlet component directs the fluid from the pressure chamber to the aperture. Finally, the aperture itself dispenses fluid out of the print head.

A print head serves as an example of a fluid dispensing assembly, with a jet stack acting as the fluid dispensing subassembly, the jet stack typically consisting of a set of plates bonded together. In the print head/jet stack example, the four components of driver, inlet, outlet and aperture become more specific. The inlet directs the ink from a manifold towards a pressure chamber, and the outlet directs the ink from the pressure chamber to the aperture plate. The driver operates on the ink in the pressure chamber to cause the fluid to exit the jet stack through the aperture plate. In the example of a jet stack, the aperture dispenses fluid out of the jet stack and ultimately out of the print head.

The term printer as used here applies to any type of drop-on-demand ejector system in which drops of fluid are forced through one aperture in response to actuation of some sort of transducer. This includes printers, such as thermal ink jet printers, print heads used in applications such as organic electronic circuit fabrication, bioassays, three-dimensional structure building systems, etc. The term 'print head' is not intended to only apply to printers and no such limitation should be implied. The jet stack resides within the print head of a printer, with the term printer including the examples above.

Figure 1:
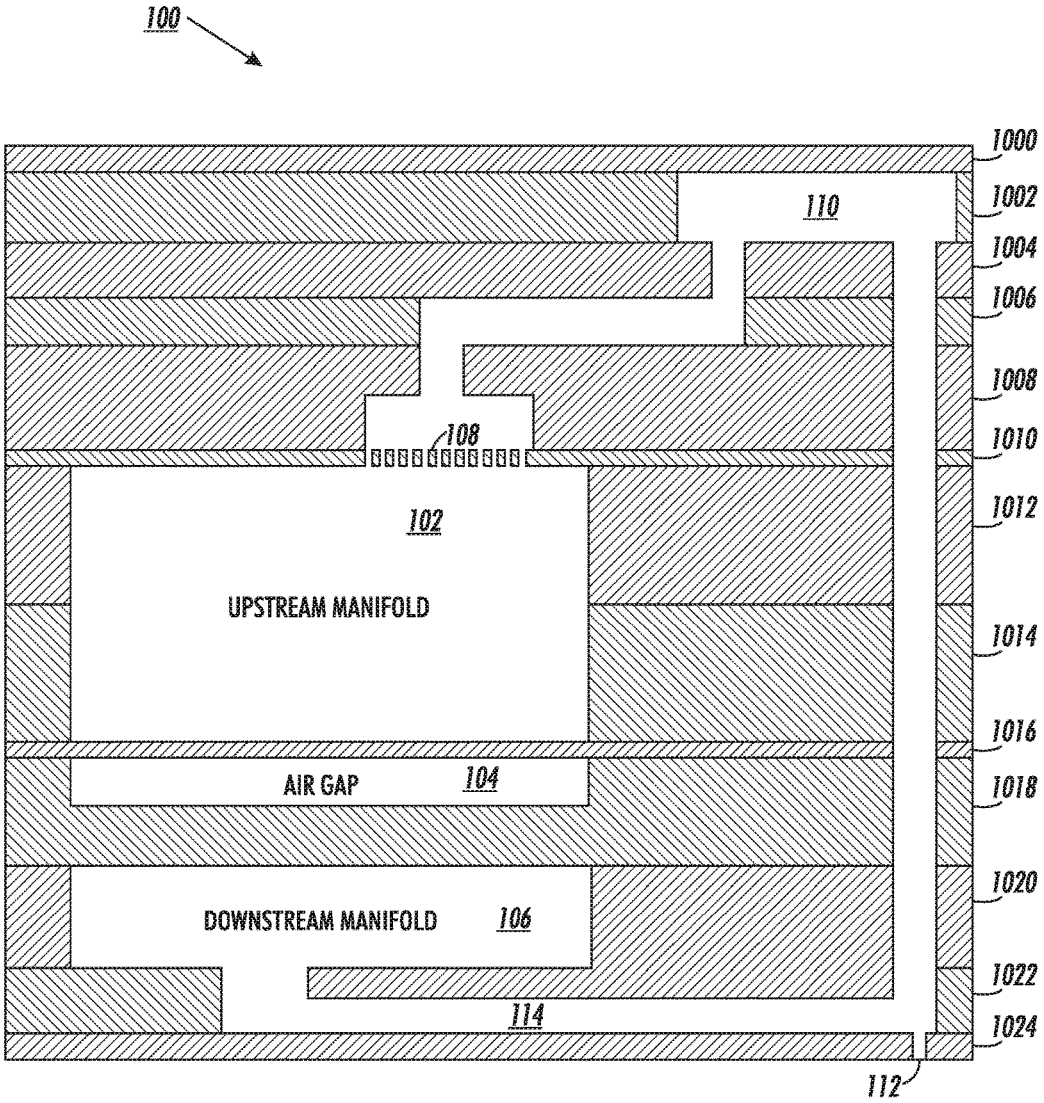
FIG. 1 shows an example of a fluid dispensing subassembly of a single jet element.

FIG. 1 shows an example of a jet stack in a print head. The jet stack 100 consists of a set of plates bonded together in this example and will be used in the discussion. It should be noted that this is just an example and no limitation to application or implementations of the invention claimed here. As will be discussed further, the terms 'printer' and 'print head' may consist of any system and structure within that system that dispenses fluid for any purpose. Similarly, while a jet stack will be discussed here to aid in understanding, any fluid dispensing subassembly may be relevant. The fluid dispensing subassembly or fluid dispensing body may be comprised of a set of plates, as discussed here, a molded body that has the appropriate channels, transducers, and apertures, a machined body, etc. As aspects of the embodiments include additional structures inside the jet stack than just the plates, the set of plates may be referred to as the fluid dispensing body within the fluid dispensing subassembly.

As mentioned above, the jet stack 100 consists of a plurality of plates 1000-1024. Preferably, each of the plurality of plates 1000-1024 is a stainless steel plate. Plate 1000 has a piezoelectric element (not shown) attached that facilitates ink ejection during a jetting event. Each of the plates 1000-1024 is chemically etched so that when the plurality of plates 1000-1024 are stacked they create the upstream manifold 102, the air gap 104, the downstream manifold 106, the particle filter 108, the channel 110, the aperture 112, and the recirculation channel 114.

To create the various components of the jet stack, the plurality of plates 1000-1024 are chemically etched from one or both sides. As mentioned above, when the plates 1000-1024 are stacked together, the chemically etched portions of the plates 1000-1024 create the various components of the jet stack. The aperture 112 is a hole etched through plate 1024. To create the channel 110, plates 1000-1024 are etched. To create recirculation channel 114, plate 1022 is only etched from one side to create a half-etched channel that leads to the downstream manifold 106. Preferably, the recirculation channel 114 is 1.65 mm to 4.445 mm long, 0.076 mm to 0.152 mm wide and 0.0381 mm to 0.1016 mm deep. However, the recirculation channel 114 is not limited to this length, width, and depth, and may be any size necessary for each jet element.

The jet stack receives ink from a reservoir (not shown) through upstream manifold 102 having a particle filter 108. The output from the particle filter 108 flows into channel 110. The channel 110 directs liquid to aperture 112 and recirculation channel 114. The particle filter 108 prevents large particles from flowing into the channel 110 and ejecting through aperture 112 or being sent to the downstream manifold 106. When an actuator or transducer (not shown) activates, it causes a diaphragm plate to deflect, and causes ink to flow through aperture 112. The ink drops exiting the aperture 112 form a portion of a printed image. The part of the ink path that includes the particle filter 108, upstream manifold 102, channel 110, and aperture 112 is referred to as the "single jet element." The recirculation path includes channel 114 and downstream manifold 106. Recirculation channel 114 is connected to channel 110.

When the actuator or transducer are not activated, ink in channel 110 flows to recirculation channel 114 and downstream manifold 106 without ejecting through the aperture 112, as will be discussed in more detail below. This allows the ink to continue to flow without an ejection and prevent the ink from becoming quiescent.

Figure 2:
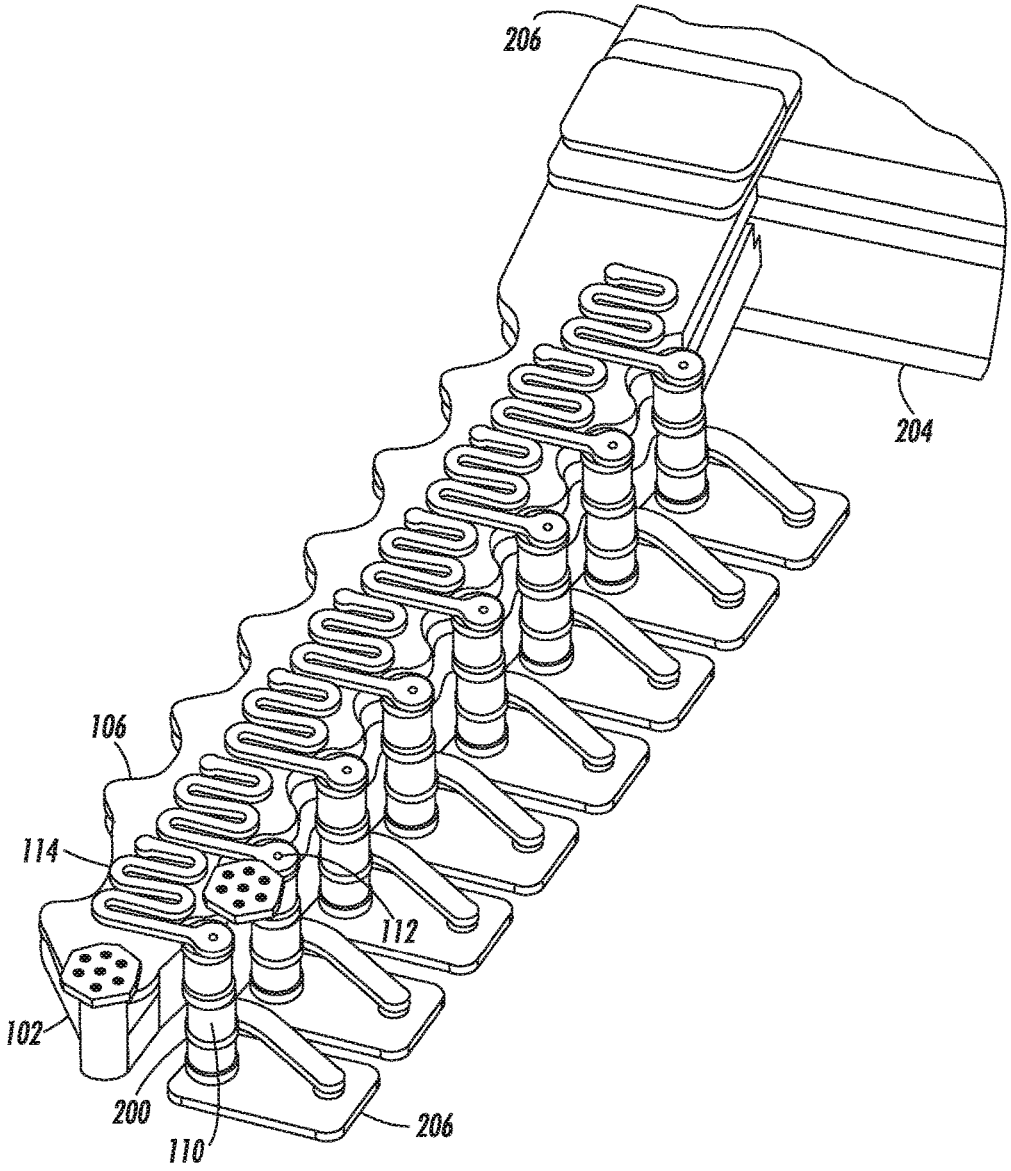
FIG. 2 shows a plurality of single jet elements.

FIG. 2 shows a diagram of one embodiment of a system having a fluid dispensing assembly that includes a fluid dispensing subassembly. The configuration of the printer is merely to aid in understanding of the context of the implementation of the invention. Further, the examples discussed herein may refer to ink instead of fluid and jet elements instead of a fluid dispensing subassembly. Again, no limitation is intended nor should be implied.

FIG. 2 shows an embodiment of a plurality of single jet elements 200 connected to an inlet manifold 204 and an outlet manifold 202 that connect to the upstream manifold 102 and the downstream manifold 106, respectively. Although eight single jet elements 200 are shown, any number of single jet elements 200 may be used as would be understood by one skilled in the art.

The upstream manifold 102 and the downstream manifold 106 also each respectively connected to each of the single jet elements 200. That is, the jet stack 100 includes a single upstream manifold 102 and a single downstream manifold 106, each of which are connected to each of the jet elements 200. Each of the single jet elements 200 are formed by the stainless steel plates 1000-1024 shown in FIG. 1. As can be seen in FIG. 2, each single jet element includes an aperture 112 for ejecting ink during a jetting or printing event.

Each single jet element 200 also includes a body chamber 206. The body chamber 206 has a piezoelectric element (not shown) on the back that facilitates ink ejection during a jetting event, as discussed and explained above. That is, the body chamber 206 is formed via plate 1000 and connected to the piezoelectric element (not shown).

Figure 3:
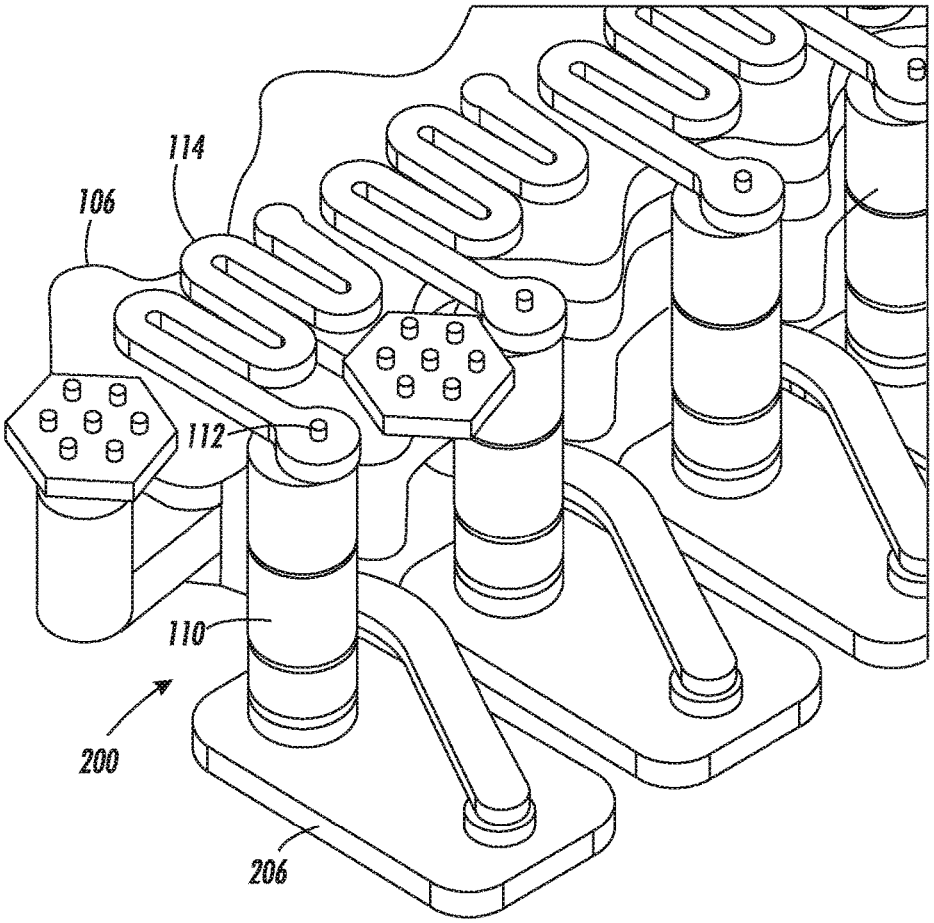
FIG. 3 shows a first view of a single jet element with a recirculation channel.
Figure 4:
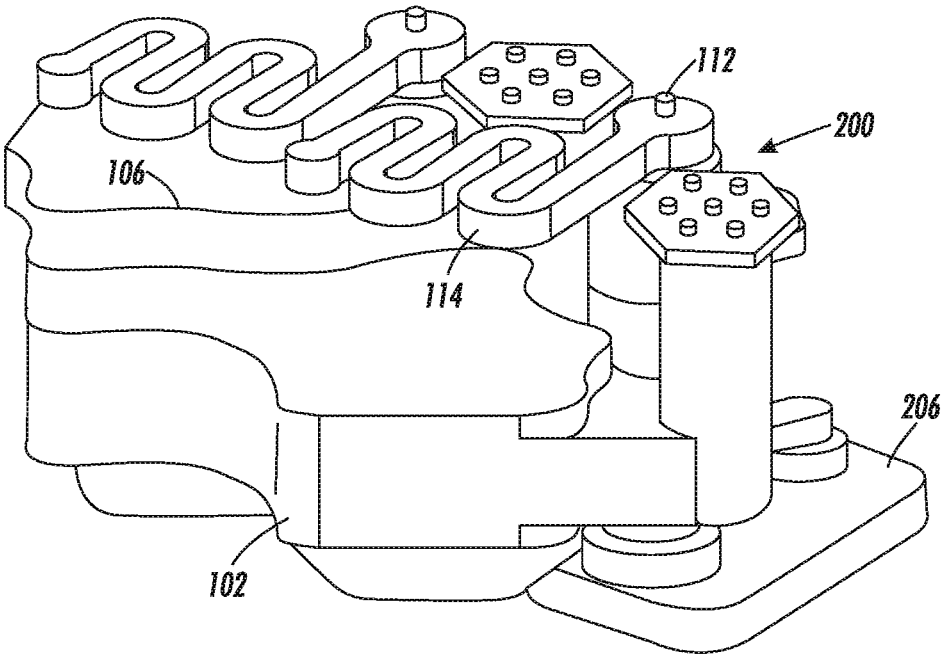
FIG. 4 shows a second view of a single jet element with a recirculation channel.

FIGS. 3 and 4 show a more detailed view of one of the single jet elements 200 from FIG. 2. As noted above, the single jet element 200 includes the particle filter 108, aperture 112, the channel 110, and the upstream manifold 102, as seen in FIG. 2.

Figure 5:
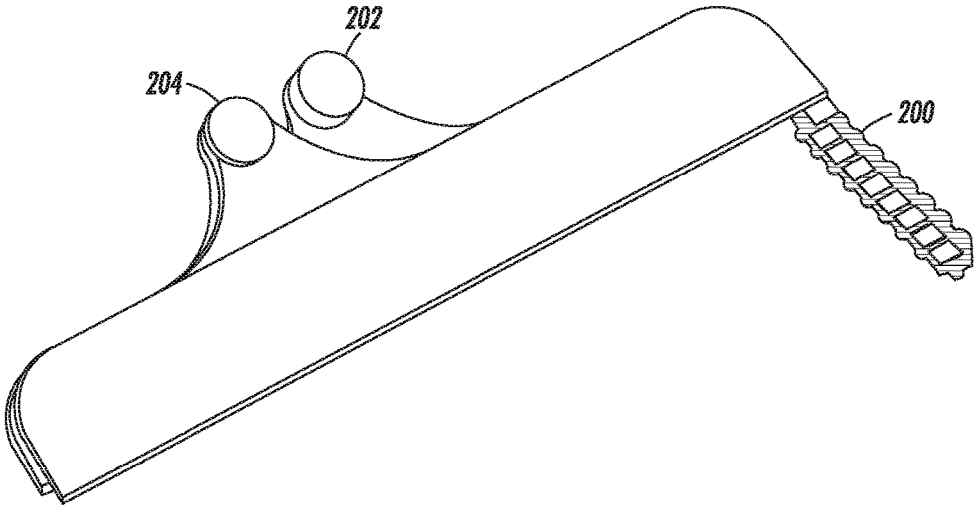
FIG. 5 shows a large view of a plurality of single jet elements connected to an inlet manifold and an outlet manifold.

FIG. 5 shows in more detail the inlet manifold 204 and the outlet manifold 202 connected to the upstream manifold 102 and the downstream manifold 106, respectively.

During a jetting event, ink is supplied from the inlet manifold 202 to the upstream manifold 102. Via operation of the piezoelectric element (not shown) attached to the body chamber 206, ink travels from the upstream manifold 102 through the particle filter 108 to the channel 110 and to the aperture 112. To get ink to flow through the aperture 112, enough pressure must be provided to break the meniscus of the ink within the aperture 112.

During a non-jetting event, however, to keep the ink moving and avoid fluidic quiescent, ink travels from the upstream manifold 102 through the particle filter 108 to the channel 110 and to the recirculation path, which includes the recirculation channel 114 and the downstream manifold 106. The meniscus of the ink in the aperture 112 stays intact so that ink is not ejected.

Therefore, there has to be less than several inches of water of pressure used to keep the ink following through the single jet element 200 but to avoid a rupture of the meniscus. For example, the upstream manifold 102 may have a negative pressure of 1 inch of water, while the downstream manifold 106 has a negative pressure of 6 to 7 inches of water. This is achieved by applying a negative pressure to the upstream manifold 102 and a lower negative pressure at the downstream manifold 106. This pressure may be applied by any means, such as a vacuum, negative pressure head, etc. During a jetting event, this differential in negative pressure between the upstream manifold 102 and the downstream manifold 106 is maintained so the ink constantly flows through the recirculation path, even during a jetting event. This results in a continuous average flow when jetting.

During a non-jetting event, ink flows through channel 110 to the aperture 112 and the recirculation channel 114. However, since, as mentioned above, the pressure is not enough during a non-jetting event to break the meniscus of the ink in the aperture 112, the pressure drives the ink to the downstream manifold 106 to be recirculated. This keeps the ink flowing through the manifolds 102 and 106 and the single jet element 200 even when ink is not being ejected during a jetting event. That is, ink constantly moves throughout the single jet element 200 even when there is no jetting event. This eliminates the ink settling and causing particles to be suspended within the ink. This is accomplished by having a suitable pressure differential between the upstream manifold 102 and the downstream manifold 106.

The range of pressure required to move ink into the half-etched portion of channel 110 rather than through aperture 112 is a function of the surface tension and viscosity of the fluid. The pressure differential should be high enough to maintain flow between the upstream manifold 102 and downstream manifold 106, but low enough to prevent rupture of the aperture 112 meniscus.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. An inkjet print head, comprising:

a plurality of single jet elements, each single jet element including:

an aperture configured to eject ink during a jetting event, and a channel for receiving ink a first manifold structured to supply ink to the channel; and a plurality of recirculation paths, each recirculation path configured to receive ink during the jetting event and a non-jetting event and each recirculation path including:

a recirculation channel connected to the channel for receiving ink, the recirculation channel is formed by half-etching one of the steel plates that forms part of the each of the single jet elements and the recirculation paths, and a second manifold structured to receive ink from the recirculation channel, wherein the ink flows from the first manifold to the second manifold through each of the plurality of single jet elements and the recirculation paths during a non-jetting event, wherein a negative pressure is applied to the first manifold and a lower negative pressure is applied at the second manifold creating a pressure differential between the first manifold and the second manifold.

2. The inkjet print head of claim 1, wherein the ink constantly flows through the inkjet print head during non-jetting.

3. The inkjet print head of claim 1, wherein the pressure differential between the first manifold and the second manifold is maintained during a jetting event.

4. The inkjet print head of claim 3, wherein the ink constantly flows through the print head during a jetting event.

5. The inkjet print head of claim 1, wherein the negative pressure applied to the first manifold and the lower negative pressure applied at the second manifold is less than the amount of pressure required to break a meniscus of ink located at the aperture of each single jet element.

6. The inkjet print head of claim 1, wherein the recirculation channel is 1.65 mm to 4.445 mm long, 0.076 mm to 0.152 mm wide and 0.0381 mm to 0.1016 mm deep.

7. An inkjet print head, comprising:

a jet element including:

an aperture configured to eject ink during a jetting event, and a channel for receiving ink a first manifold structured to supply ink to the channel; and a recirculation path configured to receive ink during the jetting event and a non-jetting event and each recirculation path including:

a recirculation channel connected to the channel for receiving ink, the recirculation channel is formed by half-etching one of the steel plates that forms part of the jet element and the recirculation paths, and a second manifold structured to receive ink from the recirculation channel;

wherein the ink flows from the first manifold to the second manifold through the jet element and the recirculation path during a non-jetting event; and wherein a negative pressure is applied to the first manifold and a lower negative pressure is applied at the second manifold creating a pressure differential between the first manifold and the second manifold.

8. The inkjet print head of claim 7, wherein the ink constantly flows through the inkjet print head during non-jetting.

9. The inkjet print head of claim 7, wherein the pressure differential between the first manifold and the second manifold is maintained during a jetting event.

10. The inkjet print head of claim 9, wherein the ink constantly flows through the print head during a jetting event.

11. The inkjet print head of claim 7, wherein the negative pressure applied to the first manifold and the lower negative pressure applied at the second manifold is less than the amount of pressure required to break a meniscus of ink located at the aperture of each single jet element.

12. The inkjet print head of claim 7, wherein the recirculation channel is 1.65 mm to 4.445 mm long, 0.076 mm to 0.152 mm wide and 0.0381 mm to 0.1016 mm deep.

13. A method of controlling pressures in a print head, comprising:

applying a first negative pressure to a first manifold structure connected to a channel during a non-jetting event;

applying a second negative pressure lower than the first negative to a second manifold structure downstream from the first manifold structure to create a pressure differential, the second manifold structure connected to a recirculation channel that receives ink from the channel during a non-jetting event; and maintaining the pressure differential between the first manifold structure and the second manifold structure during a jetting event.

14. The method of claim 13, wherein the ink constantly flows through the print head during a non-jetting event.

15. The method of claim 13, wherein the ink constantly flows through from the first manifold structure to the second manifold structure during a jetting event.

16. The method of claim 13, wherein the negative pressure applied to the first manifold and the lower negative pressure applied at the second manifold is less than the amount of pressure required to break a meniscus of ink located at the aperture of each single jet element.

* * * * *